US006666641B2

(12) United States Patent
Weers

(10) Patent No.: US 6,666,641 B2
(45) Date of Patent: Dec. 23, 2003

(54) LAMINATED BOOK COVER

(76) Inventor: John Boyd Weers, 2019 NE. 12th St., Renton, WA (US) 98056

( * ) Notice: Subject to any disclaimer, the term of this patent is extended or adjusted under 35 U.S.C. 154(b) by 362 days.

(21) Appl. No.: 09/776,621

(22) Filed: Feb. 5, 2001

(65) Prior Publication Data

US 2002/0106507 A1 Aug. 8, 2002

(51) Int. Cl.[7] ..... B42C 11/00

(52) U.S. Cl. ..... 412/4; 412/8; 281/29; 281/36; 281/37

(58) Field of Search ..... 281/31, 19 K, 281/34, 35, 36, 37, 29; 412/1, 8, 900, 901, 902

(56) References Cited

U.S. PATENT DOCUMENTS 3,884,742 A * 5/1975 Roberts ..... 156/257
4,519,630 A * 5/1985 Holmes ..... 281/34
4,527,814 A * 7/1985 Carter et al. ..... 281/34

* cited by examiner

*Primary Examiner*—Willmon Fridie, Jr.
(74) *Attorney, Agent, or Firm*—David L. Tingey

(57) ABSTRACT

Use of plastic laminate on both sides of book covers made of paper to render them stiffer and more durable and a method for attachment of the laminated book covers when hot glue is used in the book binding process. Hot glue used in book binding will not bond with the plastic laminate. Bonding of the book laminated covers can be achieved by bonding a paper strip to the spine area of the laminated covers. The hot glue will then bond to the paper strip in the book binding process.

2 Claims, 2 Drawing Sheets

LAMINATED BOOK COVER

CROSS-REFERENCE TO RELATED APPLICATIONS

Not applicable.

BACKGROUND OF THE INVENTION

1. Field of the Invention

The invention relates to using lamination on both sides of soft book covers to improve the durability of the book covers and a method of facilitating the attachment of said book covers when hot glue is used in the process of bookbinding.

2. Prior Art

Soft book covers now in use are made of heavy and expensive paper which covers may be plastic coated. These book covers are easily dog-eared, bent or torn in use.

It is well known in the bookbinding process to form a book spine by flowing hot glue into bindings that tie book leaves together therein permanently protecting the bindings and permanently securing the leaves into a book spine.

Plastic lamination on both sides of the covers makes soft covers stronger without adding significantly to book weight but lamination on both sides has not been used because most book binders use hot glue in the bookbinding process and the hot glue used will not bond with the lamination of the covers.

It is the object of this invention to provide a durable and inexpensive cover laminated on both cover sides that is secured to book bindings with hot glue used in forming the book spine.

BRIEF SUMMARY OF THE INVENTION

This objective is achieved by laminating a soft book cover with plastic and securing the cover spine to the book spine with hot glue used in the bookbinding process. Because that hot glue does not adhere well to laminated covers, a strip is attached to the cover binder between the cover spine and the book spine. The bookbinding hot glue then attaches to the strip to secure the laminated cover to the book bindings as the hot glue flows into the bindings to form the book spine.

DETAILED DESCRIPTION OF THE PREFERRED EMBODIMENT

The use of soft book covers that are laminated with plastic on both sides is discouraged by book binders because most book binders use hot glue that does not bind to plastic laminate in the binding process. Therefore most soft book covers are made of heavy and expensive paper in an effort to try to achieve a durable cover. This invention facilitates the use of soft book covers that are laminated with plastic on both sides to provide a more durable and low cost soft book cover when hot glue is used in the process of book binding that does not bond with the laminated book covers.

Figure 2:
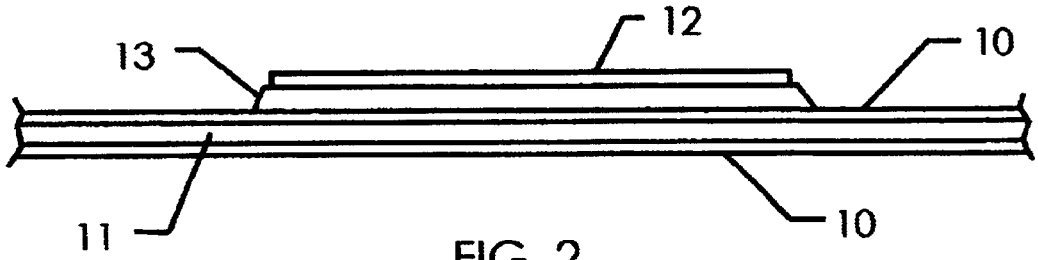
FIG. 2 is a top view of the laminated book covers showing two flat panels separated by a cover spine.
Figure 1:
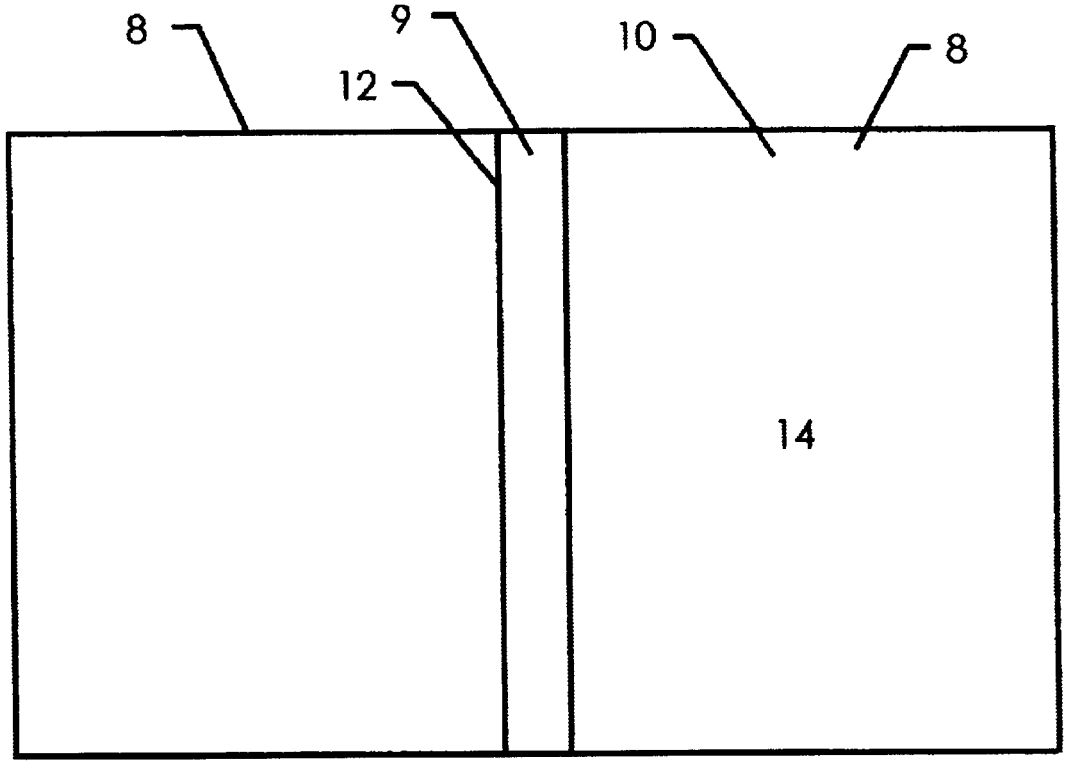
FIG. 1 is an end view of showing the laminated book covers.

Referring to FIG. 1 the book cover 11 covered on both sides with plastic laminate 10 comprises front and back panels 8 separated by cover spine 9. As shown in FIG. 2, a strip of paper 12 the width and length of the spine of the book is bonded at the cover spine 9 on the inside of the book cover with an adhesive 13 that will bond to the laminate 10 and the paper strip 12. The hot glue will bond with the paper strip 12 in the attachment of the assembled book cover 14 shown in FIG. 1 during the process of the bookbinding.

Figure 3:
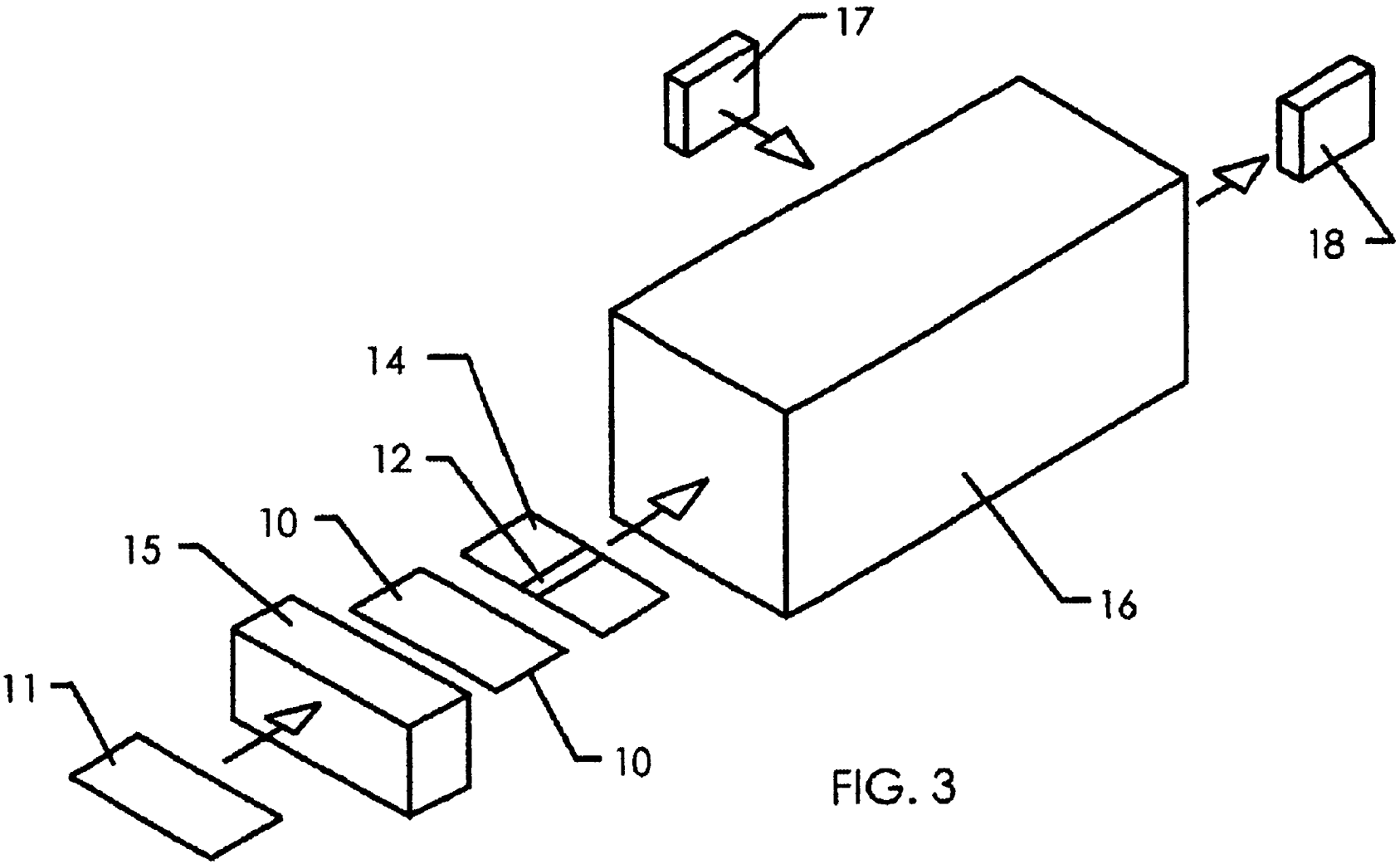
FIG. 3 is a diagrammatic system flow showing the steps of producing the book cover and attachment of the book cover to the body of the book when hot glue is used in the bookbinding machines.

Referring to FIG. 3, the assembly of the book cover begins with the printed book cover sheet 11 inserted into a commercial laminating machine 15 that laminates both sides with laminate 10 that is trimmed if required before the paper strip 12 is bonded to the spine area completing the assembled book cover 14. The assembled book cover 14 is inserted into a commercial bookbinding machine 16 along with the body of the book 17 where the hot glue used in the commercial book binding machine 16 binds the book spine 17 to the book cover at the cover spine 9, pressing the strip to the book spine as book binding glue is applied to the book spine, the book binding glue flowing into the book spine bindings and also applying to the strip 12 therein attaching the cover to the book spine to produce the assembled book 18 having the cover spine hot-glued to the book bindings of the book spine with the cover front and back panels folded in face-to-face contiguous contact with first and last leaves of the book.

What I claim as my invention is:

1. A book cover for attaching to a book having a book spine including spine bindings of book leaves glued together with book binding glue that flows into the bindings during book binding, the book cover comprising front and back cover panels separated by a cover spine, the cover panels and spine laminated on both inner and outer sides, the cover spine glued to the book spine with glue that also melts into spine bindings, a strip attached to the cover spine between the cover spine and the book spine, wherein the strip is also glued to the book spine by said book binding glue therein facilitating joinder of the book spine to the cover spine.

2. A method of binding a cover to leaves of a book tied together in bindings at a book spine, comprising the following steps:

a. laminating both sides of a cover that includes flat front and back panels separated by a cover spine, b. attaching a strip to the cover spine, c. pressing the strip to the book spine as book binding glue is applied to the book spine, the book binding glue flowing into the book spine bindings and also applying to the strip therein attaching the cover to the book spine.

* * * * *